US010513921B2

(12) United States Patent
Goodman

(10) Patent No.: US 10,513,921 B2
(45) Date of Patent: Dec. 24, 2019

(54) CONTROL LINE RETAINER FOR A DOWNHOLE TOOL

(71) Applicant: Weatherford Technology Holdings, LLC, Houston, TX (US)

(72) Inventor: Brandon C. Goodman, Houston, TX (US)

(73) Assignee: WEATHERFORD TECHNOLOGY HOLDINGS, LLC, Houston, TX (US)

( * ) Notice: Subject to any disclaimer, the term of this patent is extended or adjusted under 35 U.S.C. 154(b) by 155 days.

(21) Appl. No.: 15/362,987

(22) Filed: Nov. 29, 2016

(65) Prior Publication Data

US 2018/0148997 A1 May 31, 2018

(51) Int. Cl.

| | |
|---|---|
| ***E21B 47/12*** | (2012.01) |
| ***E21B 33/12*** | (2006.01) |
| ***E21B 17/10*** | (2006.01) |

(52) U.S. Cl.

CPC ..... *E21B 47/12* (2013.01); *E21B 17/1035* (2013.01); *E21B 33/1208* (2013.01)

(58) Field of Classification Search

CPC ..... E21B 33/1208; E21B 47/12

See application file for complete search history.

(56) References Cited

U.S. PATENT DOCUMENTS

| | | | | |
|---|---|---|---|---|
| 2,177,203 | A | 10/1939 | Bradley | |
| 2,253,092 | A | 8/1941 | Pranger | |
| 2,739,650 | A | 3/1956 | Hill | |
| 3,899,631 | A | 8/1975 | Clark | |
| 4,042,023 | A | 8/1977 | Fox | |
| 4,627,490 | A | 12/1986 | Moore | |
| 4,852,649 | A | 8/1989 | Young | |
| 4,917,187 | A | 4/1990 | Burns et al. | |
| 5,096,209 | A | 3/1992 | Ross | |
| 5,184,677 | A | 2/1993 | Dobscha | |
| 5,226,485 | A | 7/1993 | Dobscha et al. | |
| 5,377,444 | A * | 1/1995 | Gibney, Sr. | A01K 93/00 43/44.91 |
| 5,479,991 | A | 1/1996 | Robison et al. | |
| 5,803,170 | A | 9/1998 | Garcia-Soule et al. | |
| 5,906,240 | A | 5/1999 | Kilgore et al. | |
| 6,026,897 | A | 2/2000 | Pringle et al. | |
| 6,109,357 | A | 8/2000 | Zimmerman | |
| 6,173,788 | B1 | 1/2001 | Lembcke et al. | |
| 6,220,362 | B1 | 4/2001 | Roth et al. | |
| 6,286,603 | B1 | 9/2001 | Parent | |
| 6,325,144 | B1 | 12/2001 | Turley et al. | |
| 6,481,496 | B1 | 11/2002 | Jackson et al. | |

(Continued)

FOREIGN PATENT DOCUMENTS

| | | | |
|---|---|---|---|
| CA | 2506923 | A1 | 7/2004 |
| EP | 1554459 | A1 | 7/2005 |

(Continued)

OTHER PUBLICATIONS

UK Combined Search and Examination Report dated Mar. 15, 2018, for United Kingdom Patent Application No. GB1719219.6.

*Primary Examiner* — D. Andrews

(74) *Attorney, Agent, or Firm* — Patterson + Sheridan, LLP

(57) ABSTRACT

A method of coupling a control line to a packer includes disposing the control line in a groove of a sealing element and a slot of a retainer; and rotating the retainer relative to the sealing element to retain the control line in the groove.

26 Claims, 8 Drawing Sheets

(56) References Cited

U.S. PATENT DOCUMENTS

| | | | | |
|---|---|---|---|---|
| 6,568,481 | B2 | 5/2003 | Koehler et al. | |
| 6,575,251 | B2 | 6/2003 | Watson et al. | |
| 6,595,292 | B2 | 7/2003 | Purkis et al. | |
| 6,609,567 | B2 | 8/2003 | Ingram et al. | |
| 6,745,844 | B2 | 6/2004 | Henderson | |
| 6,808,024 | B2 | 10/2004 | Schwendemann et al. | |
| 6,877,553 | B2 | 4/2005 | Cameron | |
| 7,191,828 | B2 | 3/2007 | Arizmendi et al. | |
| 7,201,226 | B2 | 4/2007 | Gambier | |
| 7,216,720 | B2 | 5/2007 | Zimmerman | |
| 7,228,912 | B2 | 6/2007 | Patel et al. | |
| 7,264,061 | B2 | 9/2007 | Dybevik et al. | |
| 7,281,577 | B2 | 10/2007 | Rioufol et al. | |
| 7,431,082 | B2 | 10/2008 | Holt et al. | |
| 7,441,605 | B2 | 10/2008 | Coronado et al. | |
| 7,458,420 | B2 | 12/2008 | Rioufol et al. | |
| 7,510,017 | B2 | 3/2009 | Howell et al. | |
| 7,556,093 | B2 | 7/2009 | Grigsby et al. | |
| 7,562,709 | B2 | 7/2009 | Saebi et al. | |
| 7,699,115 | B2 | 4/2010 | Baaijens et al. | |
| 7,703,507 | B2 | 4/2010 | Strickland | |
| 7,748,459 | B2 | 7/2010 | Johnson | |
| 7,762,322 | B2 * | 7/2010 | Andersen | E21B 17/023 166/118 |
| 7,762,344 | B2 | 7/2010 | Courville et al. | |
| 7,784,532 | B2 | 8/2010 | Sevre et al. | |
| 7,793,718 | B2 | 9/2010 | Patel et al. | |
| 7,832,471 | B2 | 11/2010 | Verzwyvelt et al. | |
| 7,836,960 | B2 | 11/2010 | Patel et al. | |
| 7,841,409 | B2 | 11/2010 | Gano et al. | |
| 7,866,708 | B2 | 1/2011 | Johnson et al. | |
| 7,878,252 | B2 | 2/2011 | Smith et al. | |
| 7,896,070 | B2 | 3/2011 | Lovell | |
| 7,913,769 | B2 | 3/2011 | Bolding et al. | |
| 7,997,338 | B2 | 8/2011 | Foster et al. | |
| 8,006,773 | B2 | 8/2011 | Courville et al. | |
| 8,082,990 | B2 | 12/2011 | Lovell et al. | |
| 8,083,000 | B2 | 12/2011 | Nutley et al. | |
| 8,225,861 | B2 | 7/2012 | Foster et al. | |
| 8,256,508 | B2 | 9/2012 | Bolding et al. | |
| 8,312,934 | B2 | 11/2012 | Coronado | |
| 8,371,374 | B2 | 2/2013 | Foster et al. | |
| 8,434,571 | B2 | 5/2013 | Kannan et al. | |
| 8,596,369 | B2 | 12/2013 | Andersen et al. | |
| 2007/0012436 | A1 | 1/2007 | Freyer | |
| 2007/0158060 | A1 | 7/2007 | Baaijens et al. | |
| 2009/0250228 | A1 | 10/2009 | Loretz et al. | |
| 2010/0065284 | A1 | 3/2010 | Freyer | |
| 2010/0230902 | A1 | 9/2010 | Castillo et al. | |
| 2010/0236775 | A1 | 9/2010 | Sevre et al. | |
| 2010/0236779 | A1 | 9/2010 | Nutley et al. | |
| 2011/0056706 | A1 | 3/2011 | Brooks | |
| 2011/0259579 | A1 | 10/2011 | Foster et al. | |
| 2013/0008643 | A1 | 1/2013 | Castillo et al. | |
| 2013/0146311 | A1 | 6/2013 | Hathcoat et al. | |
| 2014/0227923 | A1 * | 8/2014 | Snyder, II | F16L 1/24 441/133 |

FOREIGN PATENT DOCUMENTS

| | | | |
|---|---|---|---|
| WO | 2004057715 | A2 | 7/2004 |
| WO | 2011/012838 | A2 | 2/2011 |

* cited by examiner

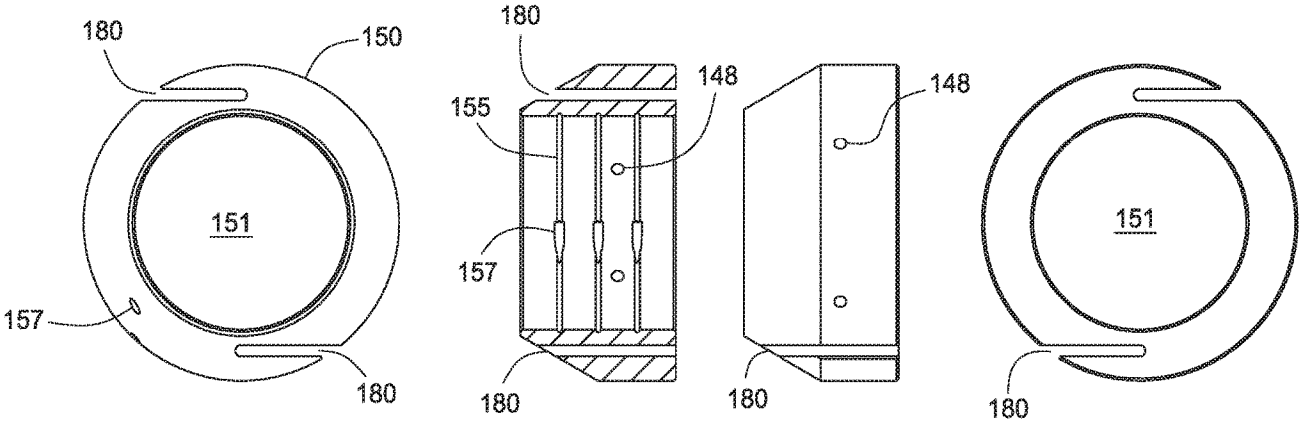
FIG. 3A
FIG. 3D
FIG. 3C
FIG. 3B
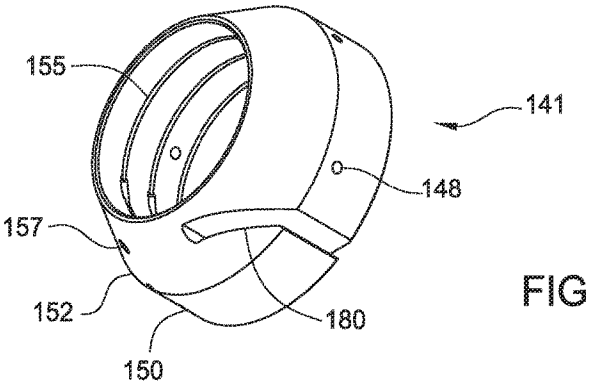
FIG. 3

CONTROL LINE RETAINER FOR A DOWNHOLE TOOL

BACKGROUND OF THE INVENTION

Field of the Invention

The present invention relates to apparatus and methods of installing a line on a downhole tool.

Description of the Related Art

A packing element is used on a downhole tool of a tubing string to create zonal isolation, for example, between production zones during hydraulic fracturing and during the production of an oil or gas well. In some implementations, various types of lines may be run along the tubing string and may need to pass the isolation provided by the packing element. Typically, the line can be a fiber optic cable used to convey data, or the line can be a hydraulic control line or the like.

One way to pass the line past the packing element involves positioning the line between the tool's mandrel and the internal dimension of the packing element. In this arrangement, the sealing abilities of the packing element are not particularly affected, and the packing element can help protect the line during run in. However, for some types of lines, such as continuous feed-through lines, integrating the line in this arrangement requires the packing element and the line to be assembled on the rig before deployment, which can be tedious and can delay operations. In addition, being able to use a continuous feed-through line that does not have any connectors and the like can be complicated. Overall, integrating a line on the packing element requires special considerations that typically equate to rig time, cost, and a restriction in the type of feed-through mechanism employed.

One method of passing a continuous control line is using split gauge rings that are assembled on the packer on the rig floor, or gauge rings that are only partially assembled on the rig floor with addition of steel plates with bolts. Split gauge rings can be expensive in their manufacture. Also, split gauge rings for a large tool size may become problematic to handle due to their weight. Gauge rings utilizing plates and bolts are also problematic as they may not have sufficient strength to securely hold the control lines in certain applications and well environments.

Further, split gauge rings are complex to manufacture, which may result in excessive material loss and high manufacturing costs. The bolts for affixing the halves of the gauge ring about the mandrel may be susceptible to failure under high pressures. These bolts might also fail in configurations where the bulk of the gauge ring is sent to the field affixed to the mandrel, but the control line is secured by a secondary plate against the main gauge ring. Multi-pieced gauge rings on the rig floor may also see issues with parts getting lost or damaged. In larger diameter tools, weight may become an issue as safety regulations may limit how much a worker can lift.

There is a need, therefore, for a more effective way to retain a control line that passes through a downhole tool, such as a packer.

SUMMARY OF THE INVENTION

In one embodiment, a method of coupling a control line to a packer includes disposing the control line in a groove of a sealing element and a slot of a retainer; and rotating the retainer relative to the sealing element to retain the control line in the groove.

In another embodiment, a method of coupling a control line to a packer includes disposing the control line in a groove of a sealing element and a slot of a retainer; and rotating the retainer relative to the sealing element to move the control line from a first position in the groove to a second position in the groove.

In another embodiment, a packer includes a mandrel; a sealing element disposed around the mandrel; a longitudinal groove formed along the sealing element for receiving a line; a retainer disposed around the mandrel and rotatable relative thereto, the retainer having a slot configured to receive the line, wherein the slot is rotatable relative to the groove to move the line from a first position in the groove to a second position in the groove.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

FIG. 3 is a perspective view of an exemplary embodiment of a retainer. FIGS. 3A and 3B are, respectively, a top view and a bottom view of the retainer. FIGS. 3C and 3D are, respectively, a side view and a cross-sectional view of the retainer.

DETAILED DESCRIPTION OF THE PREFERRED EMBODIMENT

Embodiments of the present disclosure relates to a retainer for use with a downhole tool to retain a control line passing through the downhole tool, such as a packer. In this disclosure "control lines" or "lines" is used generally and relates to any line, cord, wire, cable, etc. that runs from one end of a tubular string towards an opposite end.

Figure 1:
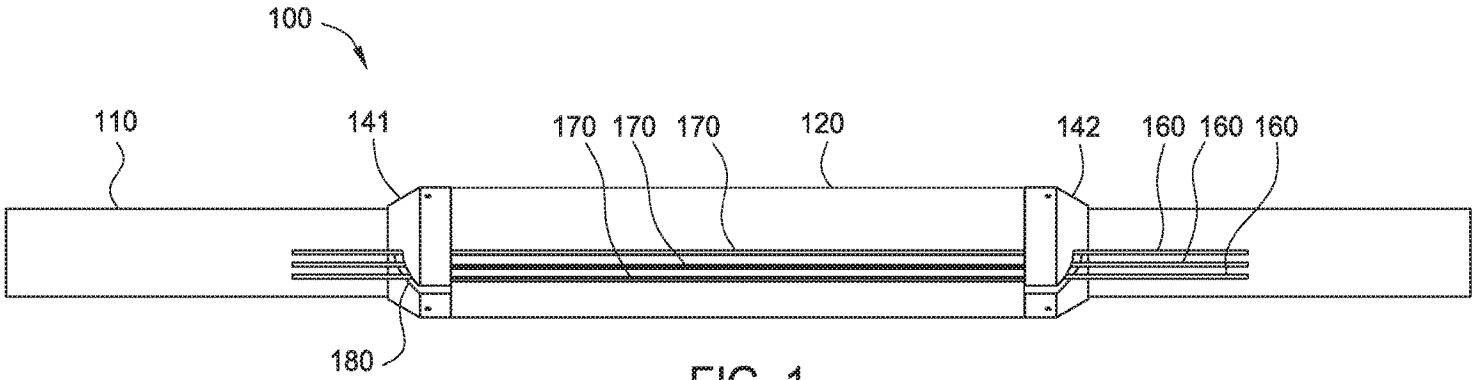
FIG. 1 is a perspective view of an exemplary embodiment of a packer.
Figure 1A:
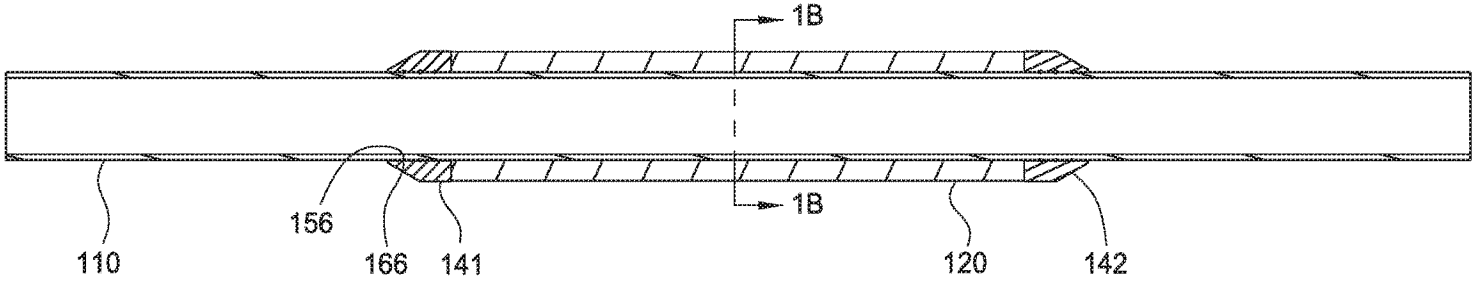
FIG. 1A is a cross-sectional view of the packer.
Figure 1C:
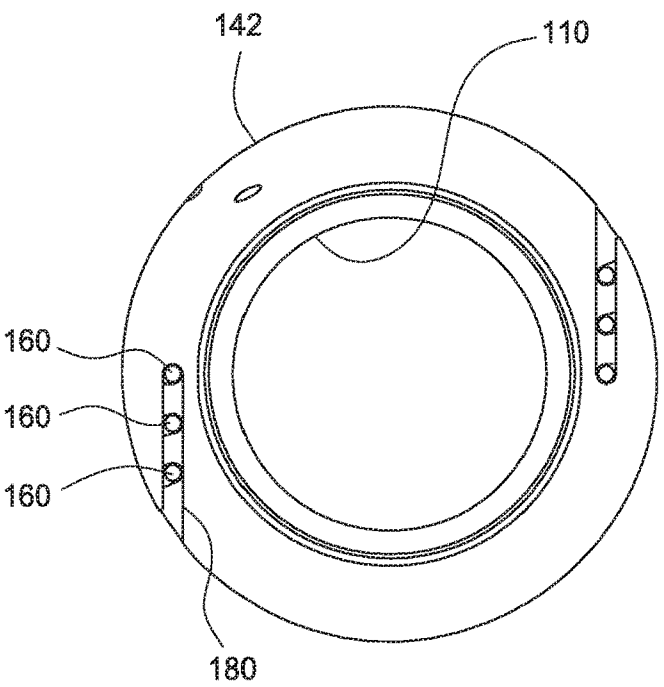
FIG. 1C is a perspective view of the right side of packer.
Figure 1B:
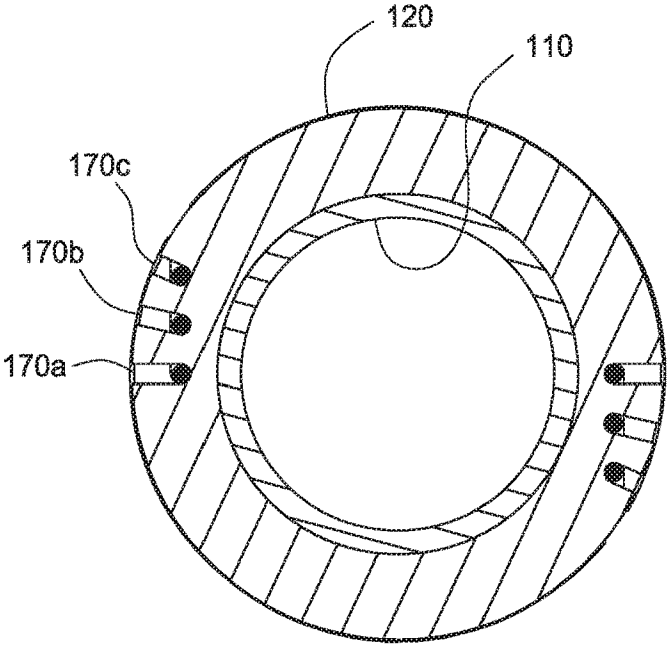
FIG. 1B is a cross-sectional view of the packer taken at line 1B-1B.
Figure 2:
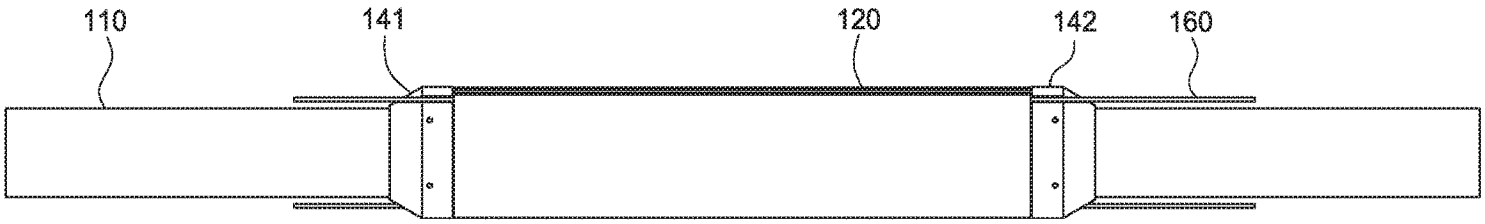
FIG. 2 is a perspective view of the packer of FIG. 1 rotated ninety degrees.
Figure 2A:
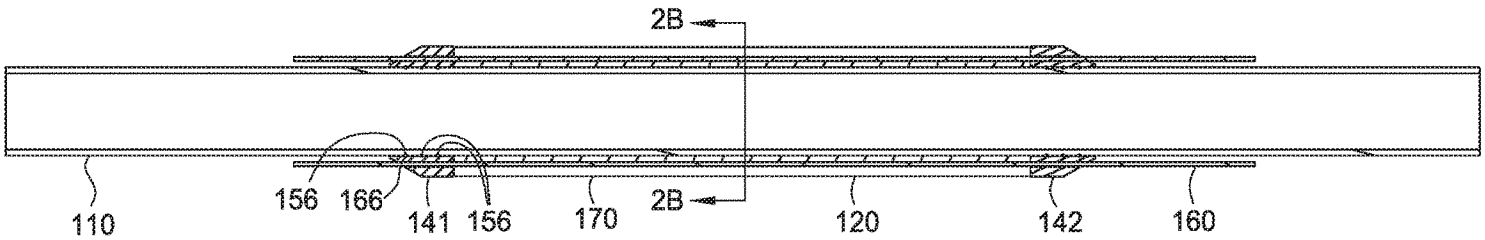
FIG. 2A is a cross-sectional view of the packer.
Figure 2B:
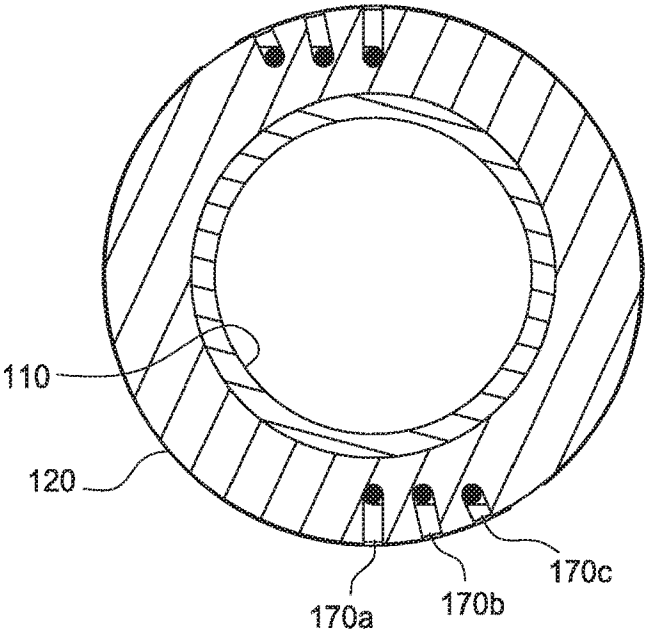
FIG. 2B is a cross-sectional view of the packer taken at line 2B-2B.
Figure 2C:
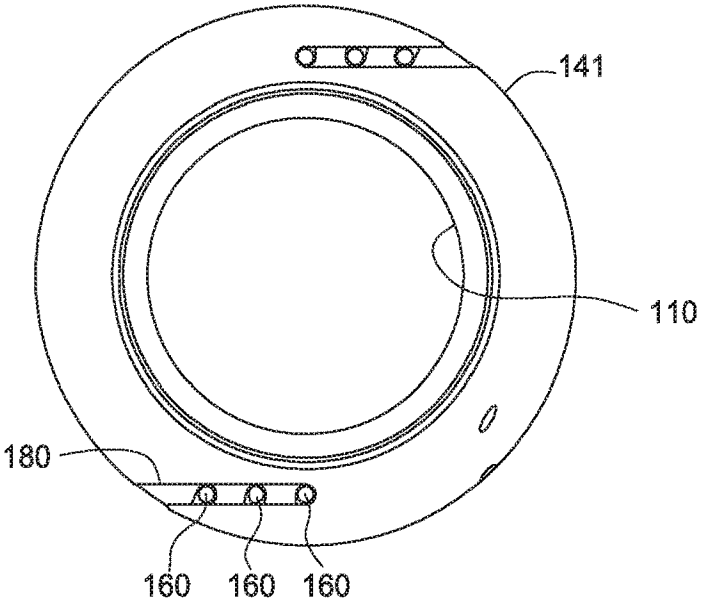
FIG. 2C is a perspective view of the left side of packer.

FIG. 1 is a perspective view of an exemplary embodiment of a downhole tool such as a packer 100. FIG. 1A is a cross-sectional view of the packer 100. FIG. 1B is a cross-sectional view of the packer 100 taken at line 1B-1B. FIG. 1C is a perspective view of the right side of packer 100. FIG. 2 is a perspective view of the packer 100 of FIG. 1 rotated ninety degrees. FIG. 2A is a cross-sectional view of the packer 100. FIG. 2B is a cross-sectional view of the packer 100 taken at line 2B-2B. FIG. 2C is a perspective view of the left side of packer 100. The packer 100 includes a mandrel 110, a sealing element 120 disposed on the mandrel 110, and a retainer 141, 142 disposed on the mandrel 110 at each end of the sealing element 120.

The sealing element 120 includes one or more grooves 170 formed into the outer surface and configured to receive a control line 160. The grooves 170 extend longitudinally from one end of the sealing element 120 to the other end. In this embodiment, the sealing element 120 includes two sets of three grooves 170, each groove 170 having a control line 160 disposed therein. While six grooves 170 are shown, it must be noted the sealing element 120 may have any suitable number of grooves to accommodate the control lines required for a particular application. For example, the sealing element 120 may have any of one to twelve or more grooves. The sealing element 120 is composed of an elastomeric material. In one embodiment, the elastomeric material may swell when it contacts a particular fluid, such as a wellbore fluid. The sealing element 120 is configured to swell sufficiently so that it contacts a surrounding tubular, thereby sealing the annular area between the mandrel 110 and the surrounding tubular, such as a casing. The sealing element 120 may also serve to cover the control line 160 when the sealing element 120 swells, thereby blocking at least a portion of the groove 170 to keeping the control line 160 in the groove 170. In one embodiment, swelling of the sealing element closes the groove 170.

Referring back to FIG. 1B, the two sets of grooves 170 in the packer 100 are substantially similar, and for sake of clarity, only one set will be discussed. Each of the three grooves 170*a*, 170*b*, 170*c* has alignment in the radial direction and a different depth. The different depths allow the control line 160 to rest against the bottom of the groove 170 when retained by the retainer 141. In this embodiment, each subsequent groove 170*b* receiving a control line 160*b* has a shallower depth than the previous groove 170*a* receiving a control line 160*a*. However, it is contemplated the grooves 170 may have the same or different depths. In another embodiment, the grooves 170 may have an offset alignment with the radius.

FIG. 3 is a perspective view of an exemplary embodiment of a retainer 141. FIGS. 3A and 3B are, respectively, a top view and a bottom view of the retainer 141. FIGS. 3C and 3D are, respectively, a side view and a cross-sectional view of the retainer 141. The retainer 141 has a tubular body 150 and a bore 151 formed therethrough. The retainer 141 is disposed around the mandrel 110, and the bottom end is disposed adjacent to the sealing element 120. The top portion 152 of the retainer 141 may have an optional conical shape to facilitate movement in the casing. The retainer 141 is rotatable relative to the mandrel 110. In one embodiment, as shown in FIGS. 3 and 3D, the retainer 141 includes one or more circumferential grooves 155 formed on an inner surface of the bore 151. The circumferential grooves 155 are complementary to a respective circumferential groove 156 formed on the mandrel 110, which are shown in FIG. 1A. Although the retainer 141 is shown with three circumferential grooves 155, the retainer 141 may have one, two, four or more grooves 155. A wire 166 may be disposed between the complementary circumferential grooves 155, 156 to axially locate the retainer 141 on the mandrel 110. In one embodiment, the wire 166 can be inserted into the grooves 155, 156 from the exterior of the retainer 141 via a hole 157 formed through the retainer 141. The retainer 141 can include a locking mechanism to prevent rotation of the retainer 141 relative to the mandrel 110. In one embodiment, a locking member such as a screw may be inserted through a hole 148 in the retainer body 150.

One or more slots 180 are formed in the body 150 to accommodate the control line 160. As shown in FIGS. 3A and 3D, the slot 180 extends longitudinally from one end of the retainer 141 to the other end and extends inwardly from the exterior surface of the sealing element 120. The slot 180 is configured to cross the grooves 170 on the sealing element 120 when the retainer 141 is rotated relative to the sealing element 120. In one example, the slot 180 has a radially offset alignment when the grooves 170 are aligned radially. In another example, the slot 180 and the grooves 170 have different radially offset alignments. The FIG. 3A shows the slot 180 as a straight slot 180. However, the slot 180 may include a curvature. In one embodiment, a width of the slot 180 is sufficient to accommodate the outer diameter of at least one line.

In one embodiment, the one or more control line grooves 170*a-c* are machined into the sealing element 120 such as an elastomer. The grooves 170*a-c* run axially through the sealing element 120 and substantially parallel to the mandrel's 110 length. The retainer 141 is disposed around the mandrel 110 and secured to the mandrel 110. For example, a wire is inserted between the circumferential grooves 156, 157 of the mandrel 110 and the retainer 141 to axially fix the retainer 141 while allowing the retainer 141 to rotate relative to the mandrel 110. In another embodiment, a protrusion may be provided on the mandrel to act as end stops to limit at axial movement of the retainer 141. For example, a ring or an arcuate portion of a ring can be attached to the mandrel just above the retainer 141 to limit axial movement of the retainer 141. The packer 100 may be assembled at the rig location or offsite.

Figure 4B:
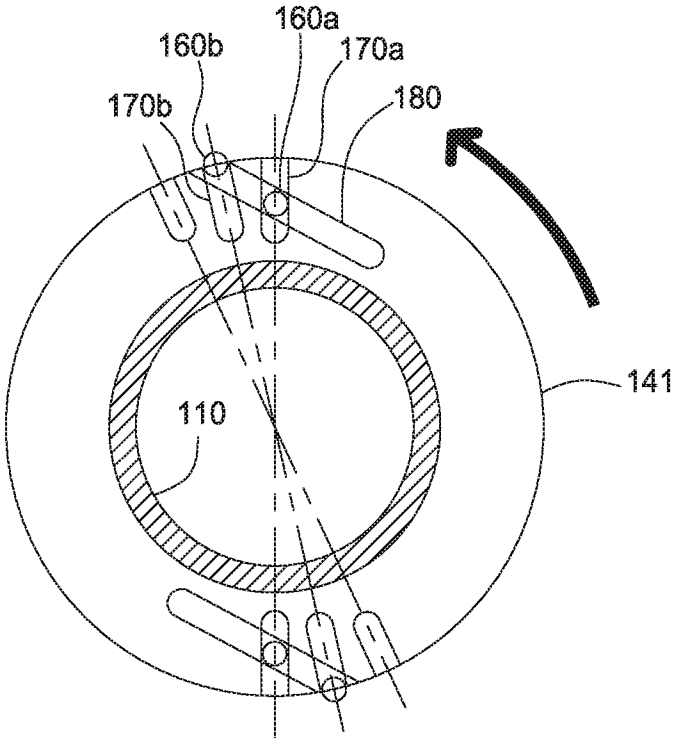
FIGS. 4A-4D are schematic, sequential views of a process for installing a control line in the packer.
Figure 4A:
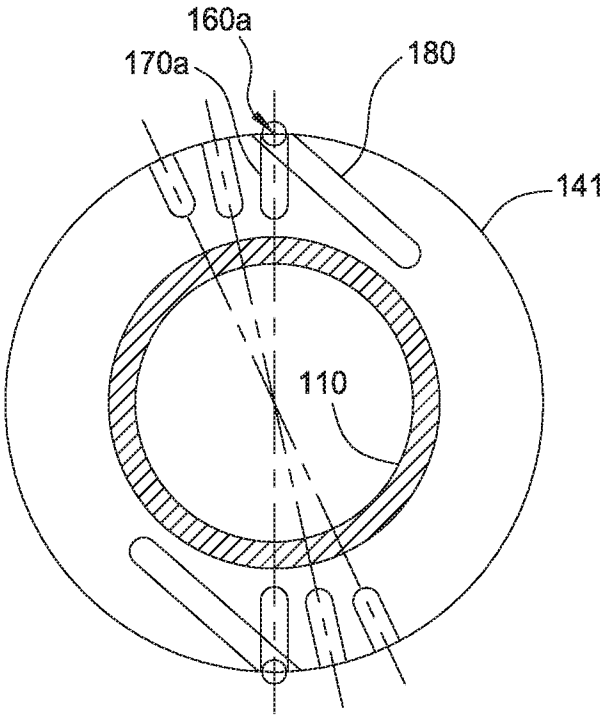

In operation, the opening of the slot 180 of the retainer 141 is aligned with the opening of the first groove 170*a* of the sealing element 120, as shown in FIG. 4A. The first control line 160*a* is positioned along the first groove 170*a* and in the aligned openings of the slot 180 and the first groove 170*a*. It must be noted that more than one control line may be disposed in each groove. The control line may be configured to transmit at least one of electricity, fluid, and data.

The retainer 141 is rotated relative to the first groove 170*a* to pull the first control line 160*a* into the first groove 170*a*, as shown in FIG. 4B. In addition, the rotated retainer 141 prevents the control line 160*a* from coming out of the first groove 170*a*. These steps can be repeated with the second retainer 142 at the other end of the sealing element 120 to retain the first control line 160*a* in the first groove 170*a*. In an example where there is only one groove in the packer 100, the retainer 141 can be rotationally fixed after the first control line has been pulled into groove 170*a*. For example, a screw is inserted into the hole 148 in the retainer body 150 to rotationally fix the retainer 141 relative to the mandrel 110.

Referring back to FIG. 4B, the retainer 141 is rotated until the opening in the slot 180 is aligned with the opening in the second groove 170*b*. The second control line 160*b* is positioned along the second groove 170*b* and in the aligned openings of the slot 180 and the second groove 170*b*.

Figure 4D:
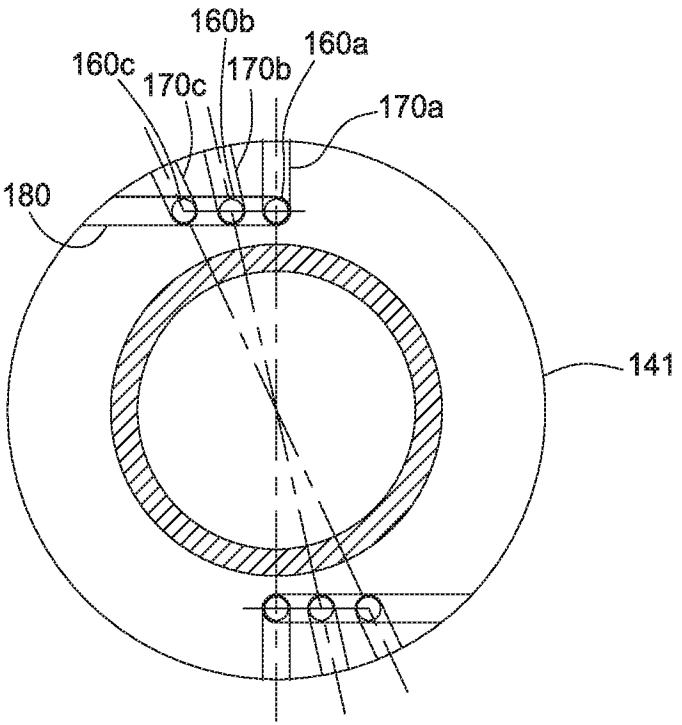
Figure 4C:
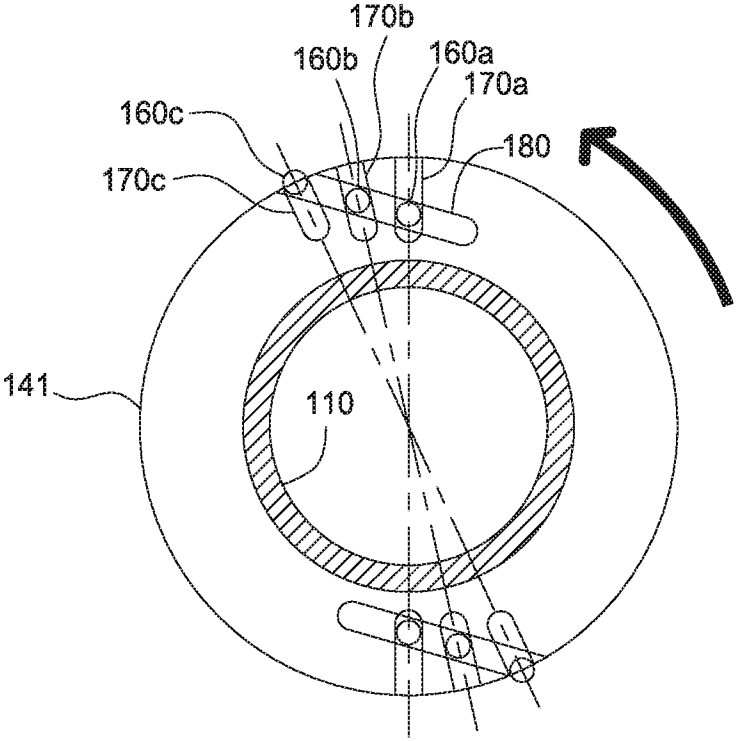

The retainer 141 is rotated relative to the second groove 170*b* to pull the second control line 160*b* into the second groove 170*b*, as shown in FIG. 4C. In addition, the second control line 160*b* is retained in the second groove 170*b* due to position of the slot 180 relative to the second groove 170*b*. Rotation of the retainer 141 also moves the first control line 160*a* lower in the first groove 170*a*.

The retainer 141 is rotated until the opening in the slot 180 is aligned with the opening in the third groove 170*c*. The third control line 160*c* is positioned along the third groove 170*c* and in the aligned openings of the slot 180 and the third groove 170*c*.

The retainer 141 is rotated relative to the third groove 170*c* to pull the third control line 160*c* into the third groove 170*c*, as shown in FIG. 4D. In addition, the third control line 160*c* is prevented from coming out of the third groove 170*c* by the retainer 141. Rotation of the retainer 141 also moves the first control line 160*a* and the second control line 160*b* lower in their respective grooves 170*a*, 170*b*. After the retainer 141 has been rotated sufficiently to prevent the third control line 160*c* from leaving the third groove 170*c*, the retainer 141 can be rotationally fixed relative to the mandrel 110. In the embodiment of FIG. 4D, the retainer 141 is rotated until the slot 180 is about 90 degrees relative to the first groove 170*a*. The depths of the three grooves 170*a-c* are configured such that the respective control lines 160*a-c* are located at or near the bottom of the grooves 170*a-c* after rotating the retainer 141. Set screws or other suitable fasteners can used to rotationally fix the retainer 141.

The same steps may be repeated using the retainer 142 to install the control lines 160*a-c* at the other end of the packer 100. Thereafter, the packer 100 is lowered into the wellbore along with the control lines. Upon swelling, the sealing element 120 can fold over the grooves to at least partially narrow the grooves.

Figure 6:
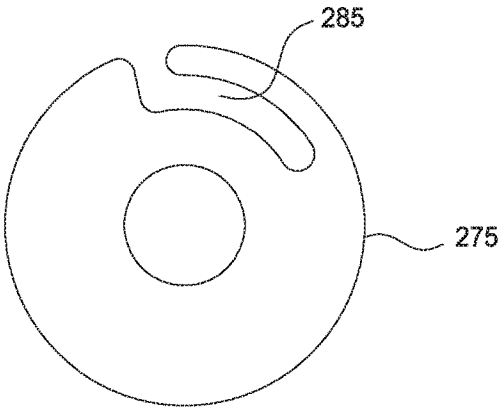
FIG. 6 illustrates another example of a slot in the retainer.
Figure 5:
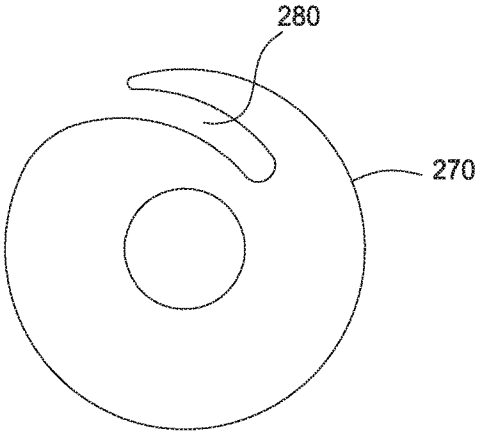
FIG. 5 illustrates an example of a slot in the retainer.
Figure 7:
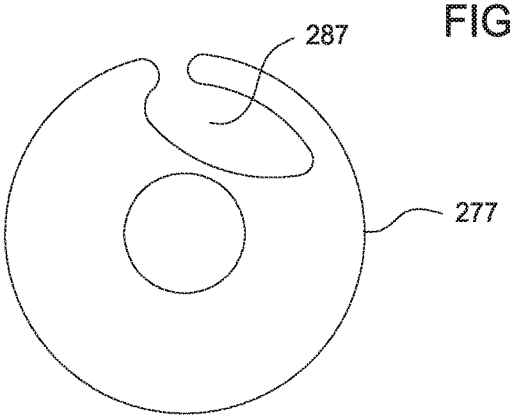
FIG. 7 illustrates another example of a slot in the retainer.

In another embodiment, the slot 280 in the retainer 270 is curved, as shown in FIG. 5. The slot 280 may be offset such that the control line is pulled lower into the groove as the retainer 270 is rotated. In another embodiment, a curvature of the slot 285 is configured to allow the control line to remain at a particular position in the groove as the retainer 275 is rotated. In the example shown in FIG. 6, the slot 285 may have the same radial distance along a portion of the curvature. In yet another embodiment, as shown in FIG. 7, the retainer 277 has a slot 287 with an irregular shape or any shape sufficient to retain the control line in the groove.

In one embodiment, a method of coupling a control line to a packer includes disposing the control line in a groove of a sealing element and a slot of a retainer; and rotating the retainer relative to the sealing element to retain the control line in the groove.

In another embodiment, a method of coupling a control line to a packer includes disposing the control line in a groove of a sealing element and a slot of a retainer; and rotating the retainer relative to the sealing element to move the control line from a first position in the groove to a second position in the groove.

In another embodiment, a packer includes a mandrel; a sealing element disposed around the mandrel; a longitudinal groove formed along the sealing element for receiving a line; a retainer disposed around the mandrel and rotatable relative thereto, the retainer having a slot configured to receive the line, wherein the slot is rotatable relative to the groove to move the line from a first position in the groove to a second position in the groove.

In another embodiment, a packer includes a mandrel; a sealing element disposed around the mandrel; a longitudinal groove formed along the sealing element for receiving a line; a retainer disposed around the mandrel and rotatable relative thereto, the retainer having a slot configured to receive the line, wherein the slot is rotatable relative to the groove to retain the line in the groove.

In one or more of the embodiments described herein, the method includes disposing a second control line in a second groove of the sealing element and the slot; and rotating the retainer relative to the sealing element to move the second control line from a first position in the second groove to a second position in the second groove.

In one or more of the embodiments described herein, the method includes disposing a third control line in a third groove of the sealing element and the slot; and rotating the retainer relative to the sealing element to move the third control line from a first position in the third groove to a second position in the third groove.

In one or more of the embodiments described herein, the sealing element and the retainer are disposed around a mandrel.

In one or more of the embodiments described herein, the retainer is rotatable relative to and axially fixed to a mandrel.

In one or more of the embodiments described herein, the groove is a first groove and is aligned radially in the sealing element.

In one or more of the embodiments described herein, a second groove is aligned radially in the sealing element.

In one or more of the embodiments described herein, the first groove and the second groove have different depths.

In one or more of the embodiments described herein, the slot is positioned about 90 degrees relative to the groove after rotation.

In one or more of the embodiments described herein, the method includes swelling the sealing element to at least narrow the groove.

In one or more of the embodiments described herein, the method includes rotating the retainer until an opening of the slot is aligned with an opening of a second groove.

In one or more of the embodiments described herein, the method includes after rotating the retainer to move the control line in the groove, locking the retainer from further rotational movement.

In one or more of the embodiments described herein, rotating the retainer relative to the sealing element moves the control line from a first position in the groove to a second position in the groove In one or more of the embodiments described herein, the retainer is axially fixed relative to the sealing element prior to disposing the control line in the groove of the sealing element and the slot of the retainer.

In one or more of the embodiments described herein, a second groove is formed along the sealing element to receive a second line.

In one or more of the embodiments described herein, the slot is rotatable relative to the second groove to move the second line from a first position in the groove to a second position in the second groove.

In one or more of the embodiments described herein, at least two grooves have different depths.

In one or more of the embodiments described herein, the groove is radially aligned.

In one or more of the embodiments described herein, the retainer is axially fixed relative to the mandrel.

In one or more of the embodiments described herein, a wire is disposed between the retainer and the mandrel to axially fix the retainer relative to the mandrel.

In one or more of the embodiments described herein, the slot has an offset alignment with a radius of the retainer.

In one or more of the embodiments described herein, the sealing element is disposed between the two retainers.

In one or more of the embodiments described herein, the slot is straight.

In one or more of the embodiments described herein, the slot includes a curvature.

In one or more of the embodiments described herein, the line is configured to transmit at least one of electricity, fluid, and data.

In one or more of the embodiments described herein, the line is selected from the group consisting of cord, wire, and cable.

In one or more of the embodiments described herein, the line is one of a fiber optic cable, electrical line, and a hydraulic line.

While the foregoing is directed to embodiments of the present invention, other and further embodiments of the invention may be devised without departing from the basic scope thereof, and the scope thereof is determined by the claims that follow.

I claim:

1. A method of coupling a control line to a packer, comprising:

disposing the control line in a groove of a sealing element and a slot of a retainer, wherein the slot has an offset alignment with a radius of the retainer; and rotating the retainer relative to the sealing element to retain the control line in the groove.

2. The method of claim 1, further comprising:

disposing a second control line in a second groove of the sealing element and the slot; and rotating the retainer relative to the sealing element to move the second control line from a first position in the second groove to a second position in the second groove.

3. The method of claim 2, wherein the slot intersects the groove and the second groove.

4. The method of claim 1, wherein rotating the retainer relative to the sealing element moves the control line from a first depth in the groove to a second depth in the groove.

5. The method of claim 1, wherein the sealing element and the retainer are disposed around a mandrel.

6. The method of claim 1, wherein the retainer is rotatable relative to and axially fixed to a mandrel.

7. The method of claim 1, wherein the groove is a first groove and is aligned radially in the sealing element.

8. The method of claim 7, wherein a second groove is aligned radially in the sealing element.

9. The method of claim 1, further comprising after rotating the retainer to move the control line in the groove, locking the retainer from further rotational movement.

10. The method of claim 1, further comprising axially fixing the retainer relative to the sealing element prior to disposing the control line in the groove of the sealing element and the slot of the retainer.

11. The method of claim 1, further comprising swelling the sealing element to at least narrow the groove.

12. The method of claim 1, further comprising rotating the retainer until an opening of the slot is aligned with an opening of a second groove.

13. The method of claim 1, wherein rotating the retainer moves the control line along a depth of the groove.

14. A packer, comprising:

a mandrel;

a sealing element disposed around the mandrel;

a longitudinal groove formed along the sealing element for receiving a line; and a retainer disposed around the mandrel and rotatable relative thereto, the retainer having a slot configured to receive the line, wherein the slot is rotatable relative to the groove to retain the line in the groove, and wherein the slot has an offset alignment with a radius of the retainer.

15. The packer of claim 14, wherein the slot is straight.

16. The packer of claim 14, wherein the slot includes a curvature.

17. The packer of claim 14, wherein the retainer is axially fixed relative to the mandrel.

18. The packer of claim 14, wherein the slot, when rotated, is configured to move the line from a first depth in the groove to a second depth in the groove.

19. The packer of claim 14, further comprising a second groove formed along the sealing element to receive a second line.

20. The packer of claim 19, wherein the slot is rotatable relative to the second groove to move the second line from a first depth in the groove to a second depth in the second groove.

21. The packer of claim 19, wherein the two grooves have different depths.

22. The packer of claim 14, further comprising a wire disposed between the retainer and the mandrel to axially fix the retainer relative to the mandrel.

23. The packer of claim 14, further comprising a second retainer, and the sealing element is disposed between the two retainers.

24. The packer of claim 14, wherein the line is configured to transmit at least one of electricity, fluid, and data.

25. The packer of claim 14, wherein the groove is radially aligned.

26. The packer of claim 14, wherein the retainer moves the line along a depth of the groove as the slot is rotated.

* * * * *